US008534100B2

(12) United States Patent
Tsai

(10) Patent No.: US 8,534,100 B2
(45) Date of Patent: Sep. 17, 2013

(54) DOOR LOCK WHOSE TRANSMISSION MECHANISM IS CONTROLLED BY A KEY

(76) Inventor: Miao-Hsueh Tsai, Taichung (TW)

( * ) Notice: Subject to any disclaimer, the term of this patent is extended or adjusted under 35 U.S.C. 154(b) by 316 days.

(21) Appl. No.: 12/873,982

(22) Filed: Sep. 1, 2010

(65) Prior Publication Data

US 2011/0056254 A1 Mar. 10, 2011

(30) Foreign Application Priority Data

Sep. 4, 2009 (TW) ..... 98216421 U

(51) Int. Cl.
*E05B 59/00* (2006.01)
*E05C 1/06* (2006.01)

(52) U.S. Cl.
USPC ..... 70/107; 70/134; 70/150; 292/32; 292/36

(58) Field of Classification Search
USPC ..... 70/103, 107, 13, 114, 116, 130, 134, 70/150, 151 A, 151 R; 292/32–37
See application file for complete search history.

(56) References Cited

U.S. PATENT DOCUMENTS

| | | | | |
|---|---|---|---|---|
| 4,118,056 | A * | 10/1978 | Alexander | 292/169.17 |
| 5,524,941 | A * | 6/1996 | Fleming | 292/34 |
| 5,765,410 | A * | 6/1998 | Kwan et al. | 70/107 |
| 6,282,929 | B1 * | 9/2001 | Eller et al. | 70/109 |
| 6,578,888 | B1 * | 6/2003 | Fayngersh et al. | 292/332 |
| 7,010,946 | B2 * | 3/2006 | Hahn | 70/111 |
| 7,197,903 | B2 * | 4/2007 | Char et al. | 70/107 |
| 7,213,426 | B2 * | 5/2007 | Qing | 70/107 |
| 7,926,315 | B2 * | 4/2011 | Poletti | 70/107 |
| 8,234,892 | B2 * | 8/2012 | Laverty et al. | 70/107 |
| 2005/0103066 | A1 * | 5/2005 | Botha et al. | 70/107 |
| 2006/0185405 | A1 * | 8/2006 | Middleton | 70/134 |
| 2007/0101776 | A1 * | 5/2007 | Naylor | 70/107 |

* cited by examiner

*Primary Examiner* — Suzanne Barrett
(74) *Attorney, Agent, or Firm* — Wang Law Firm, Inc.; Li K. Wang; Stephen Hsu

(57) ABSTRACT

A door lock whose transmission mechanism is controlled by a key. It includes a pivotal part that drives a lock tongue to retract into or extend out of the housing. A vertical bar moves vertically to drive the auxiliary lock ensembles to open or close the lock. The vertical bar uses a horizontally shifting lock chip to control the lock. The lock chip is driven by a key via a lock core.

10 Claims, 9 Drawing Sheets

DOOR LOCK WHOSE TRANSMISSION MECHANISM IS CONTROLLED BY A KEY

BACKGROUND OF THE INVENTION

1. Field of Invention

The invention relates to a door lock and, in particular, to a door lock whose transmission mechanism is controlled by a key.

2. Related Art

FIG. 9 shows a conventional door lock. In its housing 90, a key retracts a lock tongue 91 and opens it. Also a knob drives another lock tongue 92 to retract and open. They connect the auxiliary lock ensembles 93 on both ends of the door. Therefore, to open the lock, one has to use a key and turn the knob. Such a door lock structure is more complicated and expensive. It is thus an objective of the invention to solve this problem.

SUMMARY OF THE INVENTION

An objective of the invention is to provide a lock whose transmission mechanism is controlled by a key. It simplifies the door lock components and the structure thereof. The cost can thus be decreased.

To achieve the above objective, the door lock includes a main lock ensemble at the center of the door and an auxiliary lock ensemble on each end of the door. The main lock ensemble and the auxiliary lock ensemble on both ends of the door are connected by long bars. The main lock ensemble includes: a housing whose central position has a pivotal part that automatically returns to its original position after pivotally rotating to a fixed angle. The pivotal part drives a first connecting bar to move vertically and a second connecting bar to pivotally swing as it turns. As the first connecting bar moves vertically, it drives a third connecting bar to swing pivotally. One end of the third connecting bar leads a vertical bar to move vertically. One end of the housing has a position limiting element that positions the vertical bar at the unlocked state. Both ends of the vertical bar connect to the long bars of the auxiliary lock ensembles, controlling the auxiliary lock ensembles to open or close the lock. As the second connecting bar swings, it leads a lock tongue to retract into or extend out of the housing. One end of the housing has a lock core driven by a key. The lock core shifts a lock chip horizontally, and has a positioning element for positioning the lock chip after its shift. When the lock chip shifts toward the vertical bar, it blocks the vertical bar from moving sideways. It also prevents the pivotal part from extending the lock tongue.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

Figure 1:
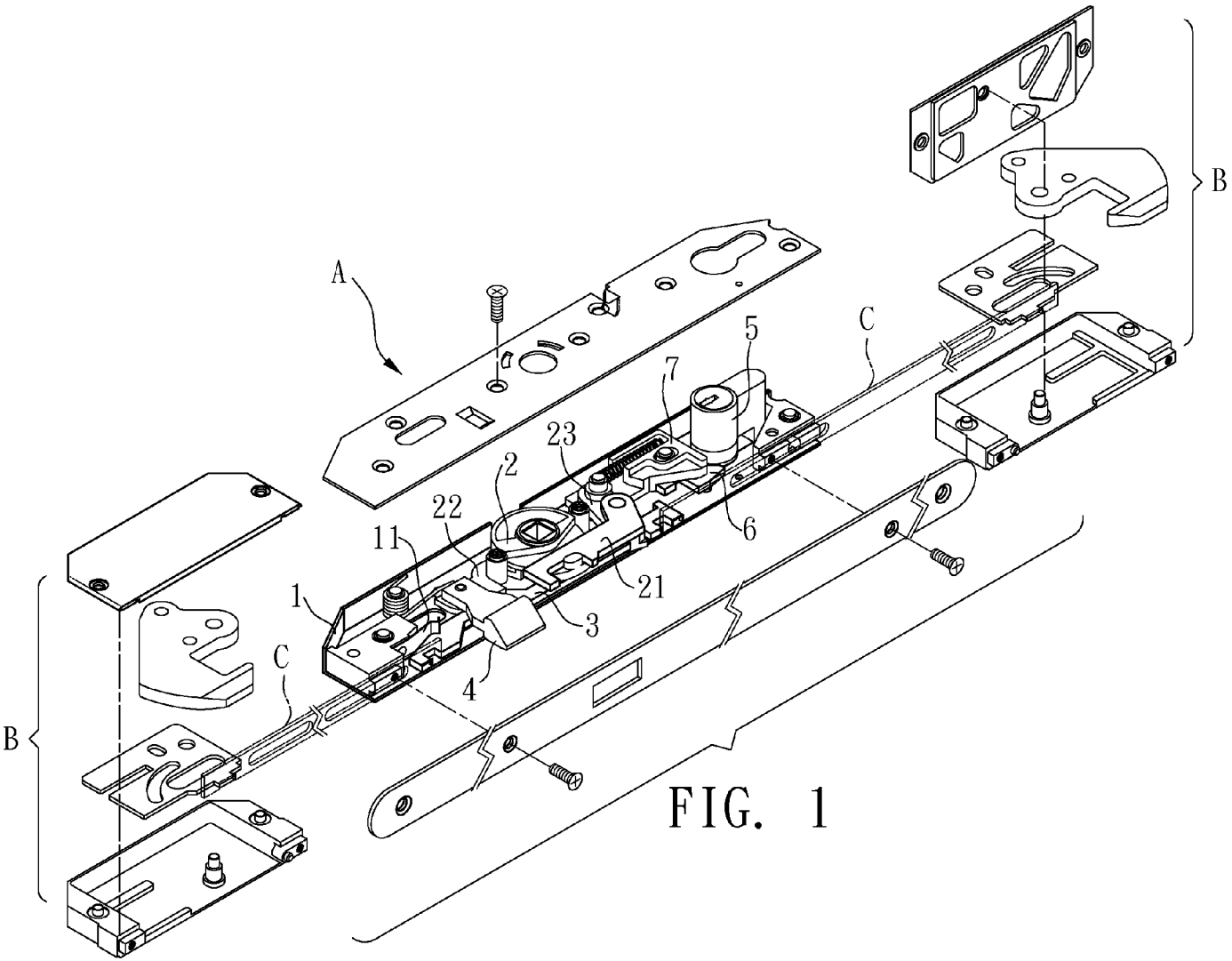
FIG. 1 is a three-dimensional view of the transmission mechanism in the disclosed door lock.
Figure 2:
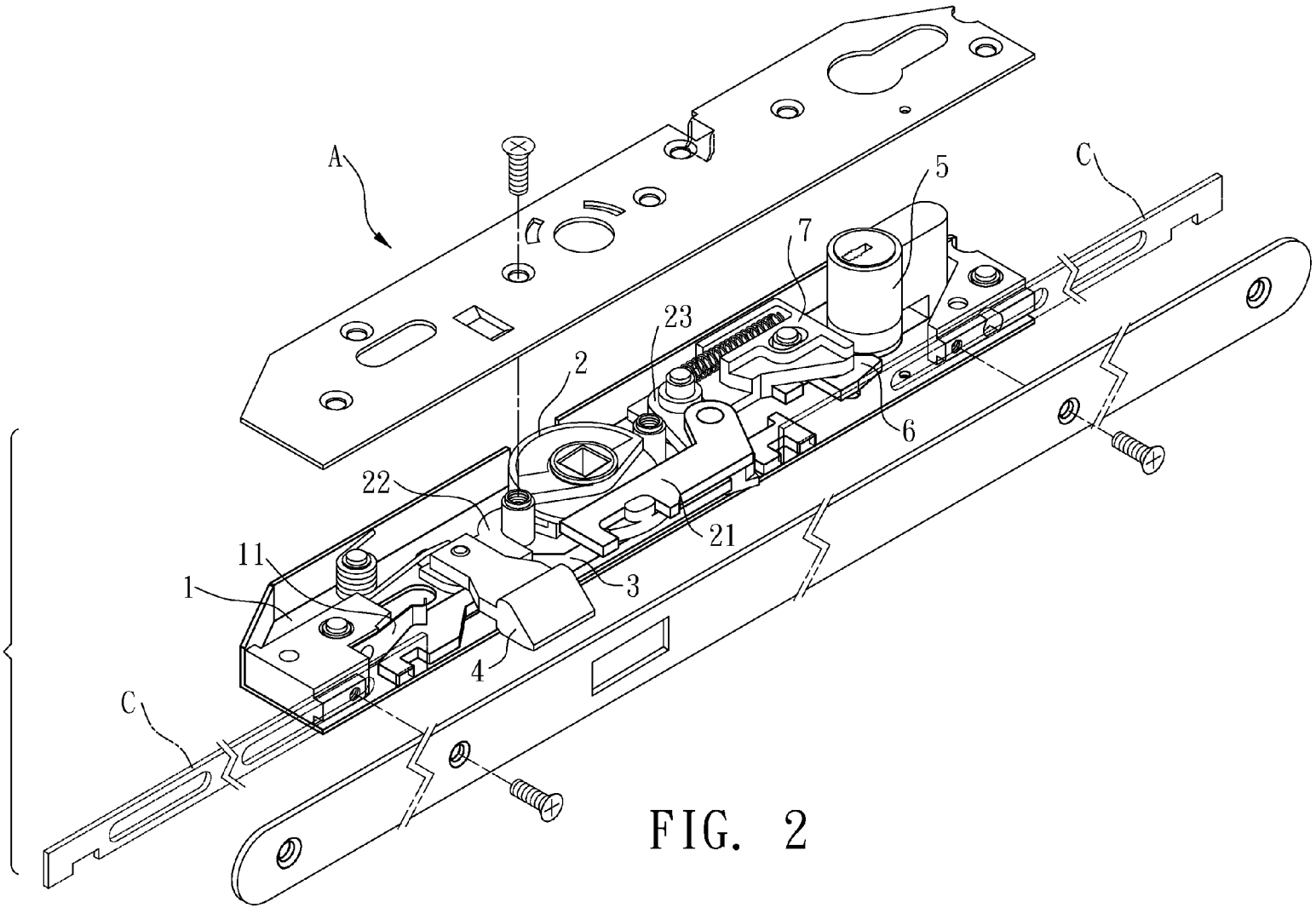
FIG. 2 is a three-dimensional assembly view of the transmission mechanism in the main lock ensemble of the invention.
Figure 3:
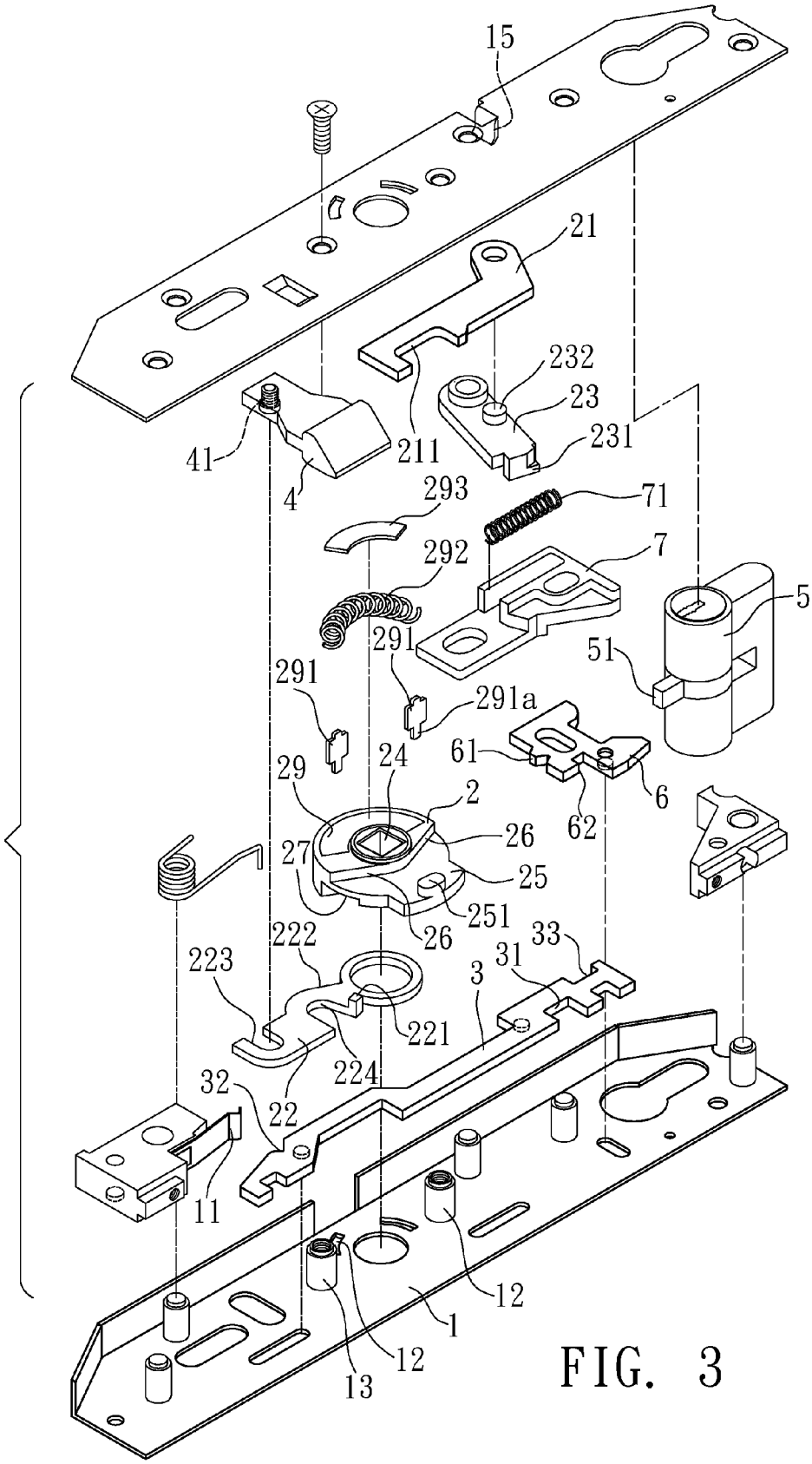
FIG. 3 is a three-dimensional exploded view of the transmission mechanism in the main lock ensemble of the invention.
Figure 4:
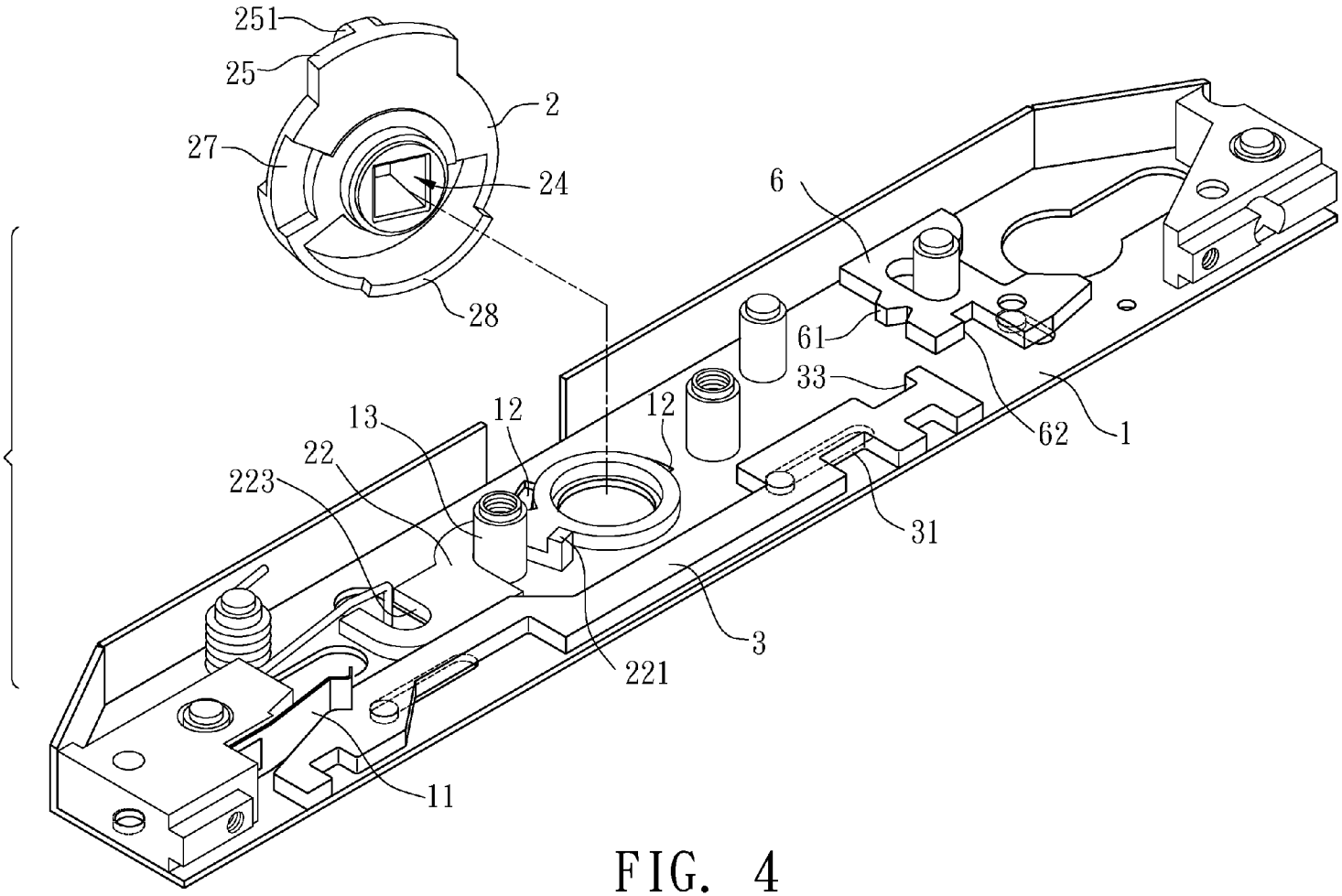
FIG. 4 shows the structure of the disclosed main lock ensemble and the bottom of the pivotal part.

The present application will be apparent from the following detailed description, which proceeds with reference to the accompanying drawings, wherein the same references relate to the same elements. For the present application, the vertical direction shall be defined as parallel lengthwise to the long side of the lock housing, and the horizontal direction shall be defined as orthogonal to the vertical direction in the plane of the lock housing.

Please refer to FIGS. 1 to 8 for an embodiment of the invention, which is only an example. This embodiment provides a door lock whose transmission mechanism is controlled by a key. The door lock includes a main lock ensemble A at the center of the door lock and two auxiliary lock ensembles B, one ensemble B on the top side of the door lock and another ensemble B on the bottom side of the door lock. The main lock ensemble A the connects to two auxiliary lock ensembles B through two long bars C, one long bar C on each side. The main lock ensemble A includes a housing 1. The center of the housing 1 has a pivotal part 2 that automatically returns to its original position after pivotally rotating to a fixed angle. As it rotates, the pivotal part 2 drives a first connecting bar 21 to move vertically and a second connecting bar 22 to pivotally swing at the same time. As the first connecting bar 21 moves vertically, it drives a third connecting bar 23 to swing. One end of the third connecting bar 23 leads a vertical bar 3 to move vertically. One end of the housing 1 has a position limiting element 11 that positions the vertical bar 3 at the unlock state. Each end of the vertical bar 3 connects to a long bar C, which is engaged to an auxiliary lock ensemble B, thereby controlling both auxiliary lock ensembles B to open or close the lock. When the second connecting bar 22 swings, it causes a lock tongue 4 to retract into or extend out of the housing 1. One end of the housing 1 has a lock core 5 driven by a key. The lock core 5 shifts a lock chip 6 horizontally, and has a positioning element 7 for positioning the lock chip after its shift. When the lock chip 6 shifts toward the vertical bar 3, it blocks the vertical bar 3 from moving vertically. It also prevents the pivotal part 2 from extending the lock tongue 4.

The center of the pivotal part 2 has an axle hole 24 for the axle bar of a knob to go through. Its bottom has an extension part 25. The top of the pivotal part 2 has two stopping walls 26. The top of the extension part 25 has a first driving part 251 that drives the first connecting bar 21 to move vertically. The bottom of the pivotal part 2 has a long arc groove 27 and a long arc wall 28. The pivotal part 2 further has a first long arc hole 29 through its top and bottom surfaces.

Both ends of the first long arc hole 29 are provided with a plate 291. The bottom of each plate 291 has a stopping part 291*a*. The housing has a second long arc hole 12 corresponding to each of the stopping parts 291*a*. The stopping part 291*a* of each plate 291 extends into the corresponding second long arc hole 12. A compressed spring 292 is disposed in the first long arc hole 29, with both ends urging against the two plates 291. The compressed spring 292 in the first long arc hole 29 has a long arc plate 293 whose length is shorter than the first long arc hole 29.

The second connecting bar 22 has a protruding part 221 at the pivotal place. The protruding part 221 is disposed in the long arc groove 27. A driving wall 222 is formed next to the protruding part 221 of the second connecting bar 22 for the long arc wall 28 to push as the pivotal part 2 rotates.

The second connecting bar 22 has a first notch 223 at the other end of the pivotal place. One end of the lock tongue 4 has a connecting part 41 disposed in the first notch 223.

A second notch 224 is formed between both ends of the second connecting bar 22. The housing 1 has a protruding post 13 corresponding to the second notch 224. When the second connecting bar 22 swings towards the protruding post 13, it urges against the protruding post 13 and stays at its vertical position for the lock tongue to extend out of the housing 1.

One end of the third connecting bar 23 is pivotally disposed on the housing 1. Its other end has a second driving part 231. A protruding post 232 is provided between the two ends. One end of the first connecting bar 21 has a third notch 211. The first driving part 251 engages the third notch 211. As the pivotal part 2 rotates, the first driving part 251 pushes the first connecting bar 21, through the third notch 211, to move vertically. It also drives the third connecting bar 23 to swing. The second driving part 231 of the third connecting bar 23 drives the vertical bar 3 to move vertically.

Each end of the vertical bar 3 connects to the long bars C of an auxiliary lock ensemble B. One end of the vertical bar 3 has a fourth notch 31 for engaging the second driving part 231. The other end has a concave part 32. When the vertical bar 3 moves toward the position limiting element 11, the lock is opened. The position limiting element 11 is elastic and makes a sound when it engages the concave part 32, indicating a successful positioning.

The positioning element 7 on the lock chip 6 urges via a compressed spring 71 against a stopping board 15 of the housing 1. It urges toward the lock core 5. The bottom of the positioning element 7 has a triangular blocking part 72. Correspondingly, the lock chip 6 has a triangular guiding part 61. When the lock chip 6 moves horizontally, the slant surfaces between the blocking part 72 and the guiding part 61 push against each other, so that the blocking part 72 of the positioning element 7 is limited to both sides of the guiding part 61. This positions the lock chip 6 when the lock is opened or closed. A sound is made when the positioning is successful.

The lock chip 6 has a blocking part 62. The vertical bar 3 has another blocking part 33 on the end opposite to the lock chip 6. When the lock chip 6 moves toward the vertical bar 3, the blocking part 62 and the blocking part 33 block each other, preventing the vertical bar 3 from moving vertically.

Figure 5:
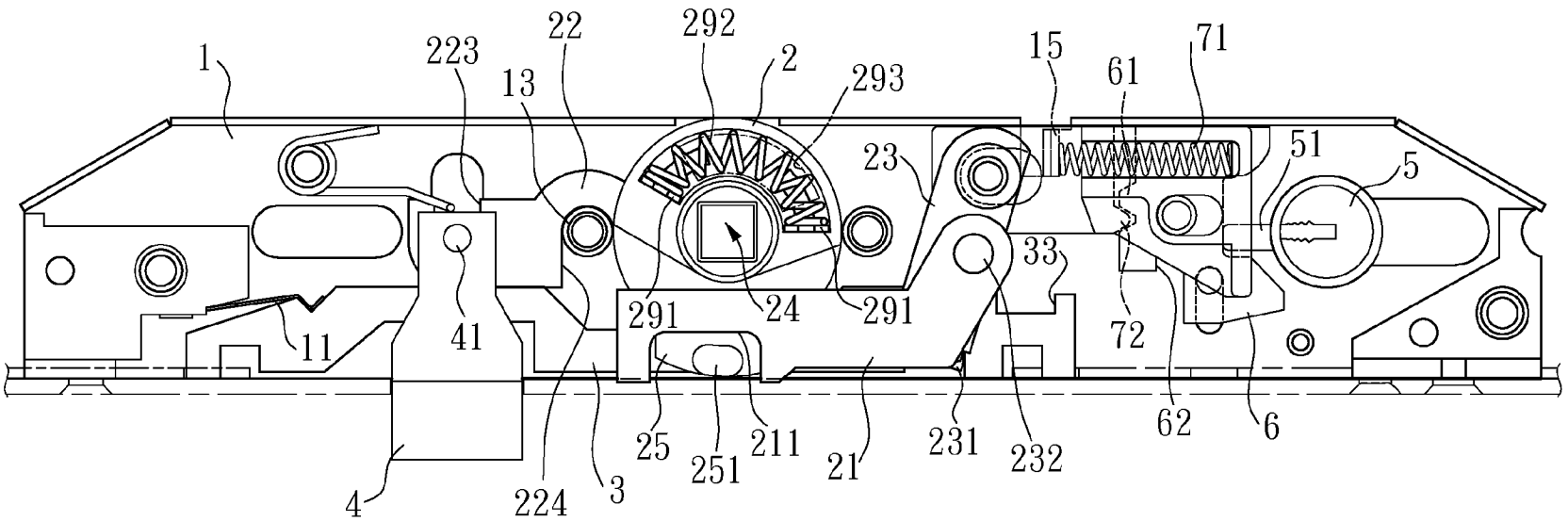
FIG. 5 is a schematic view showing the transmission for the main lock ensemble to close the lock.
Figure 6:
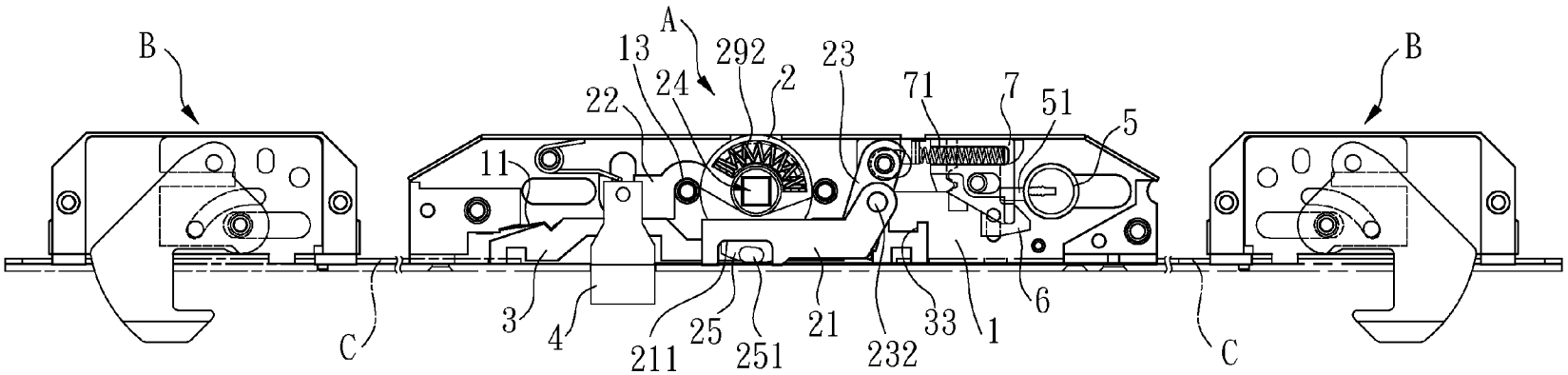
FIG. 6 is a schematic view showing the transmission for locking the door lock.
Figure 7:
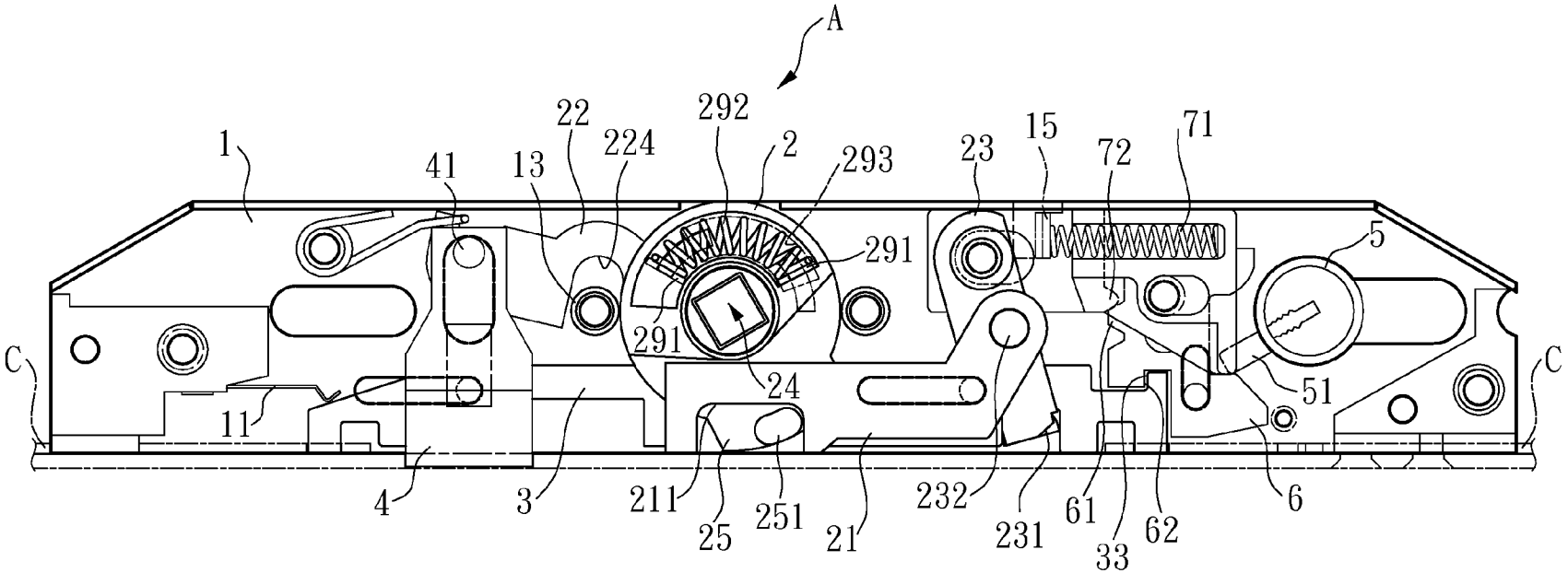
FIG. 7 is a schematic view showing the transmission for the main lock ensemble to open the lock.
Figure 8:
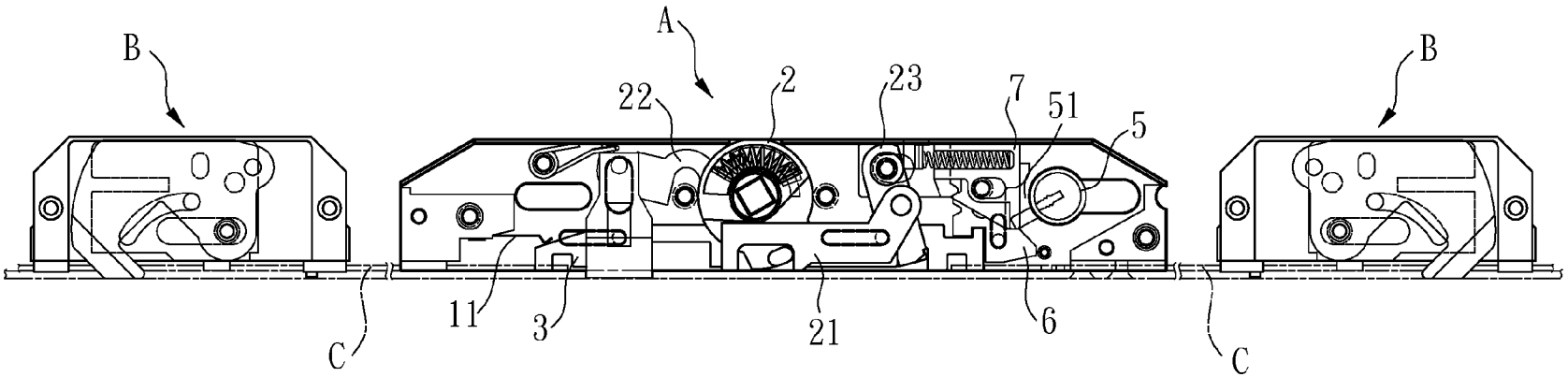
FIG. 8 is a schematic view showing the transmission for opening the door lock.
Figure 9:
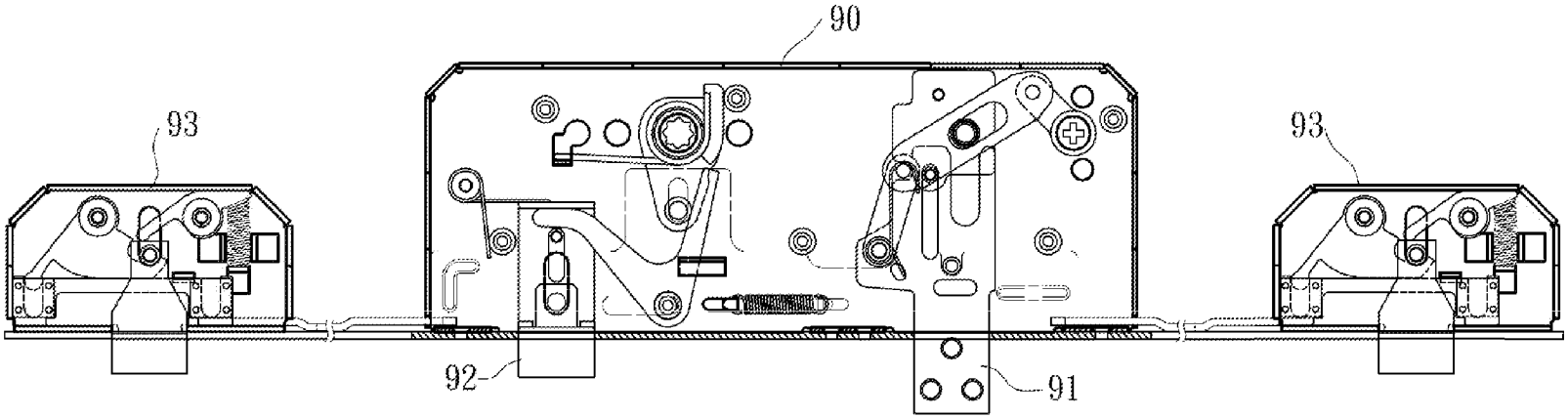
FIG. 9 PRIOR ART
FIG. 9 shows the transmission mechanism of a conventional door lock.

According to the above-mentioned door lock structure, the rotation of the lock core 5 moves the lock chip 6 horizontally. As shown in FIGS. 5 to 8, it controls whether the vertical bar 3 can move vertically. When the lock core unlocks the lock, as shown in FIGS. 5 and 6, one can rotate the pivotal part 2 via the knob. This brings the lock tongue 4 into the housing 1. It further drives the two long bars C and thus the two auxiliary lock ensembles B to unlock the lock. Therefore, the invention features simplicity in the transmission mechanism of the door lock and cheaper component costs.

Although the invention has been described with reference to specific embodiments, this description is not meant to be construed in a limiting sense. Various modifications of the disclosed embodiments, as well as alternative embodiments, will be apparent to people skilled in the art. Therefore, it is contemplated that the appended claims will cover all modifications that fall within the true scope of the invention.

What is claimed is:

1. A door lock, with a center, two ends, and a transmission mechanism controlled by a key, for a door, comprising:

a main lock ensemble at the center of the door lock;

two auxiliary lock ensembles, an one auxiliary lock ensemble on each end of the door lock; and two long bars, one long bar connecting one auxiliary lock ensemble to the main lock ensemble;

wherein the main lock ensemble includes a housing with a pivotal part that automatically returns to an original position after pivotally rotating to a fixed angle;

the pivotal part drives a first connecting bar to move vertically and a second connecting bar to swing as the pivotal part rotates;

a third connecting bar pivotally attached to the housing;

the first connecting bar movably mounted on the third connecting bar, the first connecting bar capable of driving the third connecting bar to swing as the first connecting bar moves vertically;

one end of the third connecting bar engages a vertical bar with two ends to move, vertically;

a position limiting element within the housing positions the vertical bar at an unlocked state;

each end of the vertical bar connects to one long bar of one auxiliary lock ensemble for controlling the long bar to open or close the door lock;

the second connecting bar drives a lock tongue to retract into or extend out of the housing as the second connecting bar swings;

a lock core in the housing driven by the key to shift shifts a lock chip horizontally; a positioning element in the housing adjacent to the lock chip urges and positions the lock chip; and the lock chip when horizontally shifted by the lock core prevents the vertical bar from moving so that the lock tongue is not extended by the pivotal part.

2. The door lock for a door according to claim 1, wherein the pivotal part has a top surface and a bottom surface, the pivotal part has an axle hole for an axle bar of a knob to go through, the bottom surface of the pivotal part has an extension part, the surface of the pivotal part has two stopping walls, the extension part has a first driving part for driving the first connecting bar to move vertically, the bottom surface of the pivotal part has a long arc groove and a long arc wall, and the pivotal part has a first long arc hole through the top and bottom surfaces thereof.

3. The door lock for a door according to claim 2, wherein the pivotal part has a plate on both ends of the first long arc hole, respectively;

each of the plates has a stopping part;

the housing has a second long arc hole corresponding to each of the stopping parts;

the stopping part of each of the plates extends into the corresponding second long arc hole;

a compressed spring with two ends is disposed in the first long arc hole with both ends urging against the two plates; and the compressed spring in the first long arc hole has a long arc plate whose length is shorter than the first long arc hole.

4. The door lock for a door according to claim 2, wherein the second connecting bar has two ends and pivots about one of its ends, the second connecting bar has a protruding part at its pivoting end, the protruding part is disposed in the long arc groove, and a driving wall is formed next to the protruding part for the long arc wall to push as the pivotal part rotates.

5. The door lock for a door according to claim 4, wherein the second connecting bar has a first notch at the non-pivoting end, and one end of the lock tongue has a connecting part disposed in the first notch.

6. The door lock for a door according to claim 4, wherein the second connecting bar has a second notch between its two ends, the housing has a protruding post corresponding to the second notch, and the second connecting bar urges against the protruding post as the second connecting bar swings about its pivoting end;

wherein the lock tongue extends out of the housing when the second connecting bar is urged against the protruding post.

7. The door lock for a door according to claim 2, wherein one end of the third connecting bar is pivotally disposed in the housing and its other end has a second driving part, a protruding post is formed between the two ends, one end of the first connecting bar has a third notch, the second driving part is disposed in the third notch, the second driving part drives the first connecting bar to move vertically in the third notch as the pivotal part rotates, and the third connecting bar is driven to swing so that the second driving part thereof leads the vertical bar to move vertically.

8. The door lock for a door according to claim 7, wherein each end of the vertical bar connects to one long bar of one auxiliary lock ensemble, one end of the vertical bar has a fourth notch for the second driving part to be disposed therein; the other end thereof has a concave part;

the lock is open when the vertical bar moves toward the position limiting element; and the position limiting element is elastic and makes a sound when engaging the concave part, indicating a successful positioning.

9. The door lock for a door according to claim 1, wherein the positioning element adjacent to the lock chip uses a compressed spring to urge against a stopping board on the housing, pushing the lock chip toward the lock core;

the bottom part of the positioning element has a triangular blocking part and the lock chip has a corresponding triangular guiding part, so that the triangular surfaces between the blocking part and the guiding part push against each other as the lock chip moves horizontally;

the blocking part on the positioning element is restricted to both sides of the guiding part to position the lock chip when the door lock is open and closed; and a sound is made when the positioning is successful.

10. The door lock for a door according to claim 9, wherein the lock chip has a blocking part, the vertical bar has another blocking part on the end opposite to the lock chip, and the two blocking parts block each other as the lock chip moves toward the vertical bar, preventing the vertical bar from moving vertically.

* * * * *